US005325597A

United States Patent [19]

Clifton, Jr.

[11] Patent Number: 5,325,597

[45] Date of Patent: Jul. 5, 1994

[54] HACKSAW HAND GUARD

[76] Inventor: Norman E. Clifton, Jr., 607 Trumpetvine Ct., Jacksonville, Fla. 32225

[21] Appl. No.: 64,637

[22] Filed: May 21, 1993

[51] Int. Cl.[5] ..... B27B 21/00

[52] U.S. Cl. ..... 30/514; 30/295

[58] Field of Search ..... 30/514, 517-525, 30/295, 233, 179, 382

[56] References Cited

U.S. PATENT DOCUMENTS 3,727,655 4/1973 Garcher ..... 30/514

FOREIGN PATENT DOCUMENTS 72615 8/1947 Norway ..... 30/514

*Primary Examiner*—Douglas D. Watts

*Attorney, Agent, or Firm*—Arthur G. Yeager

[57] ABSTRACT

Two-piece assembly which clamps to the frame of a hacksaw forward of and adjacent the handle and has two protective wing shields extending laterally outward from the hacksaw in front of the operator's hand. The wing shields may be integral with a hand and finger grip plastic mating portion attached to the handle of the hacksaw, or be separate and attached by bolts and nuts to the hacksaw frame forward of the handle.

20 Claims, 4 Drawing Sheets

HACKSAW HAND GUARD

BACKGROUND OF THE INVENTION

A hacksaw is a well-known hand tool for sawing through metal, plastic, and other materials which are too hard for the ordinary carpenter saw to cut. The hacksaw has a handle, usually a pistol-grip, and a frame attached to the handle to grip the two ends of a saw blade and place the blade under tension so as to keep the blade straight and taut. The materials which are cut by the hacksaw leave chips and jagged fragments when the cutting occurs, and these are potentially injurious to the hand of the operator. There have not been available on the market any protective devices to prevent injury other than gloves.

It is an object of this invention to provide a hand guard for a hacksaw. It is another object of this invention to provide a two-piece assembly for attachment to the frame of a hacksaw for protection of the hand of the operator of the hacksaw. Still other objects will become apparent from the more detailed description which follows.

BRIEF SUMMARY OF THE INVENTION

This invention relates to a hand guard for a hacksaw having a handle, a frame and a blade which comprises two mating halves which are substantially mirror images of each other, each said half including a supporting flange for clamping around the hacksaw frame adjacent said handle and a wing shield member tapering outwardly and rearwardly from said flange, said two halves being held together around said hacksaw by clamping means.

In specific embodiments of the invention the supporting flange includes a clamping groove extending in the lengthwise direction of the hacksaw and adapted to be clamped together around the frame of the hacksaw by bolt means; and the wing shields extend vertically below the level of the hacksaw blade.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The features of this invention are best understood by reference to the attached drawings, briefly described above.

Figure 1:
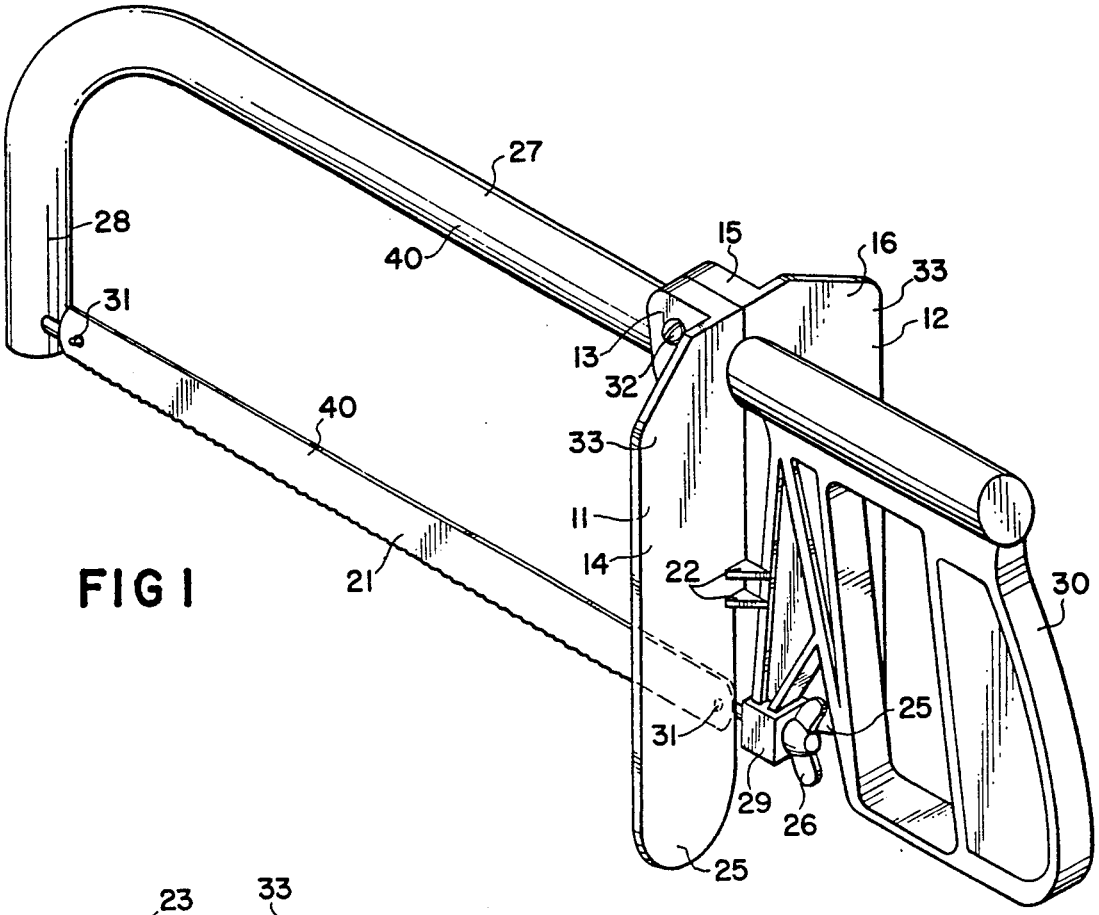
FIG. 1 is a perspective view of the hand guard of this invention affixed to a hacksaw.

In FIG. 1 there is shown a hacksaw 40 having a frame 27 with a forward end 28, a rearward end 29, and a handle 30. This frame 27 has a pin 31 at each forward end 28 and rearward end 29 to attach to holes in each end of blade 21. A wingnut 26 is manually turned to engage screw threads that tighten or loosen the tension applied to blade 21. It is, of course, important to apply tension to blade 21 in order to make blade 21 capable of cutting metal or other materials without buckling. The cross-sectional shape of frame 27 normally is circular (as shown) or rectangular.

The hand guard of this invention is an assembly of two halves which fit around frame 27 and are clamped face-to-face around frame 27 by bolt means or its equivalent. The two halves of the hand guard of FIGS. 1–6 are herein identified as the left half 11 and the right half 12, with the identification of right or left representing the halves as viewed by the operator holding handle 30 in his hand and looking forward towards forward end 28. These two halves 11 and 12 have respective flange members 13 and 15 which fit together face-to-face to produce a tight clamping assembly around frame 27 near to handle 30. This clamp is tightened or loosened by turning screw or bolt 32 in the appropriate direction.

The remainder of the hand guard comprises two wing shields 14 and 16, the former being the left wing shield and the latter being the right wing shield. Shields 14 and 16 are integral with their respective clamping flange members 13 and 15, which extend vertically from about upper ends 33 which are at the level of flange member 13 and 15 to lower ends 25 which are below the level of the blade 21. The distance which lower ends 25 extend below blade 21 is not critical, but convenience dictates that this distance be from about 0.5 to about 1.5 inches.

Shields 14 and 16 are oriented to taper or angle rearwardly and laterally outwardly from clamping flanges 13 and 15 respectively. Angle braces 22 may be included to reinforce the guards 11 and 12 against breakage of wing shields 14 and 16. Braces 22 bear against the frame 27 of hacksaw 10 on one side and are integral with shields 14 and 16 on the other side and firmly grips the frame 27 to inhibit any rotation of the shields 14 and 16.

Figure 5:
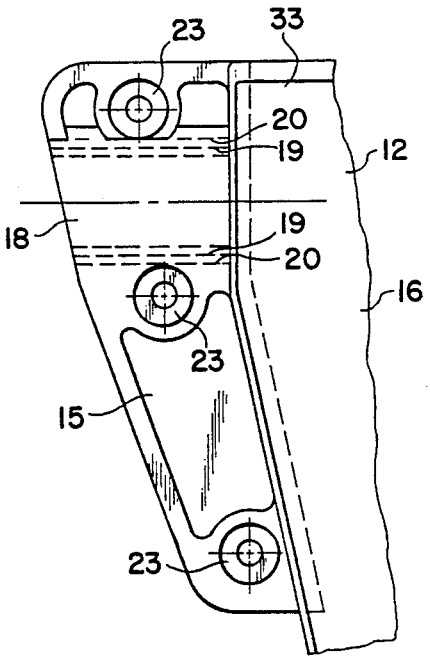
FIG. 5 is a left-side elevational view of the left half of the hand guard of this invention.
Figure 6:
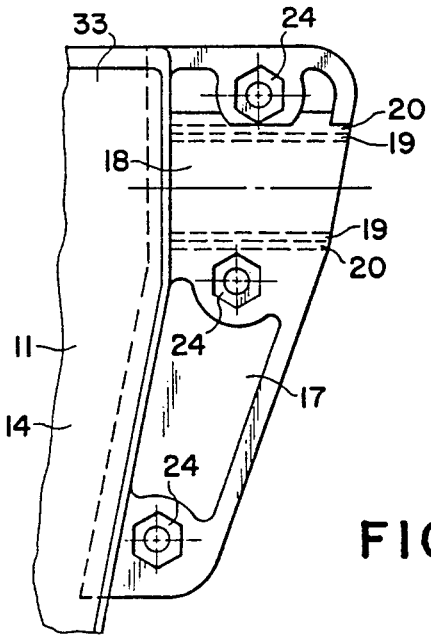
FIG. 6 is a right-side elevational view of the right half of the hand guard of this invention.
Figure 2:
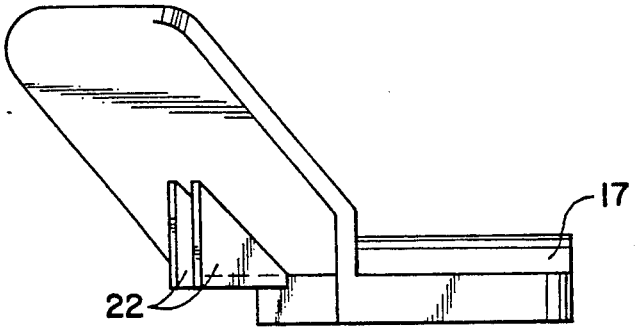
FIG. 2 is a top plan view of the hand guard of this invention.
Figure 3:
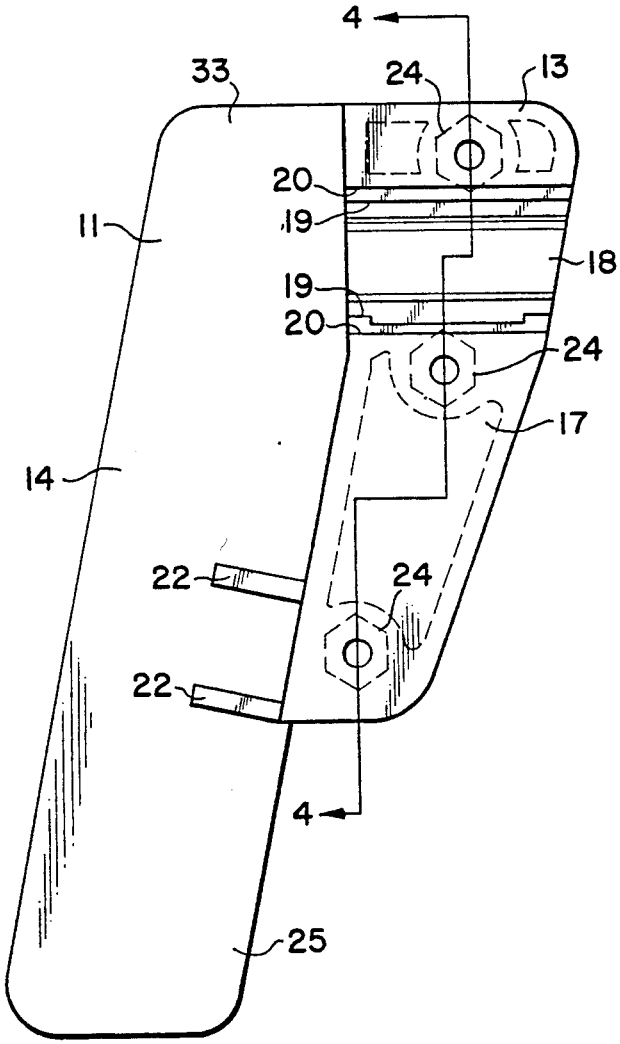
FIG. 3 is a right-side elevational view of the left half of the hand guard of this invention.
Figure 4:
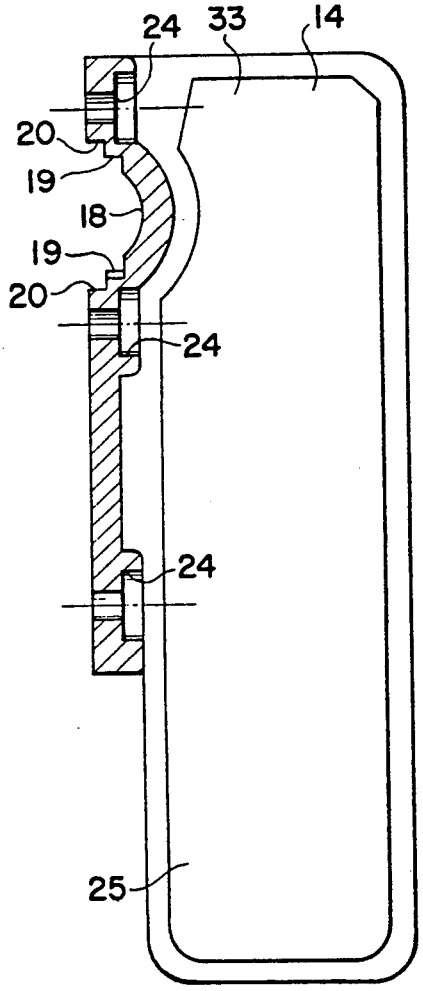
FIG. 4 is a cross-sectional view taken at 4—4 of FIG. 3.

The interior face of guard 11 is shown in FIGS. 3 and 4. The exterior of the faces of guards 11 and 12 are shown in FIGS. 5 and 6. These drawings along with FIG. 4 show that the clamping faces include a portion of a semicircular groove 18, i.e., a concave groove 18 of a radius that will approximate the radius of a circular frame 27. Adjacent groove 18, i.e., at each end of groove 18 there are two pairs of angular grooves 19 and 20 which are designed to fit rectangular frames (not shown) that are found on many commercially sold hacksaws. It should be obvious that the exact dimensions of grooves 18, 19 and 20 may be varied to meet and receive larger and smaller circular frames 27 or rectangular frames. Furthermore semicircular portion 18 may be replaced by an angular groove, preferably about 90 degrees, which would provide some flexibility in clamping around circular frames of various sizes.

The two faces of clamping flanges 13 and 15 extend vertically upward and downward sufficiently to provide a good planar seating when the halves are positioned in a face-to-face relationship; and to accommodate means for assembly, for example of at least two spaced clamping bolts, the drawings showing three such bolts including bolt 32. In FIG. 5 the right half 12 of the guard assembly includes counterbored circular holes 23 to receive bolts 32, while the left half 11 of the guard assembly includes counterbored hex-shaped holes 24 to receive tightening nuts (not shown). When the nuts are tightened on the bolts including bolt 32 the two halves 11 and 12 are clamped tightly to each other. Other bolt head shapes may be used; screws without nuts may be used if one set of holes is tapped to receive the screws; and other types of clamping means may be used. All that is necessary is that the clamping operation is easily accomplished manually by any skilled, semi-skilled or unskilled operator.

It is not critical that this hand guard be made from any special material. Plastic is preferred because of its inexpensiveness, but metals, rubber , wood or other semirigid-to-rigid materials are suitable.

Figure 7:
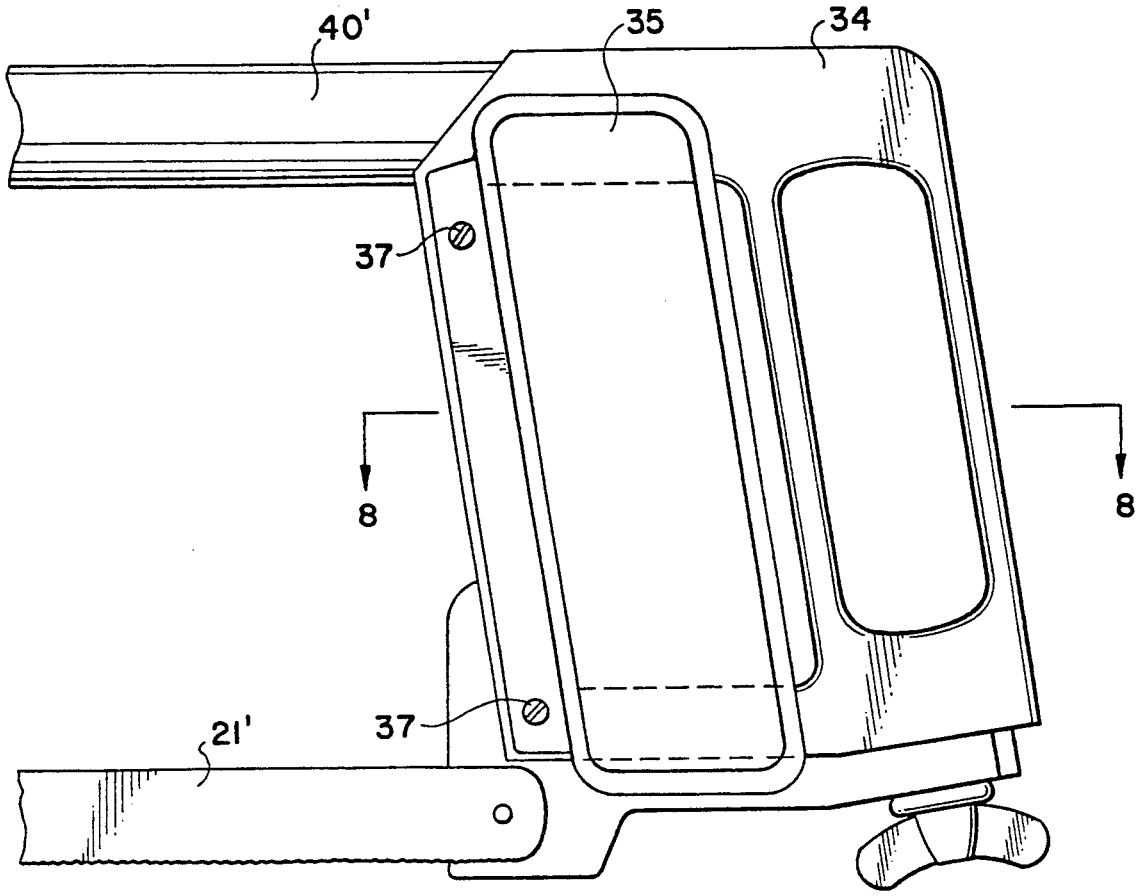
FIG. 7 is a side elevational view of a second embodiment of this invention.
Figure 8:
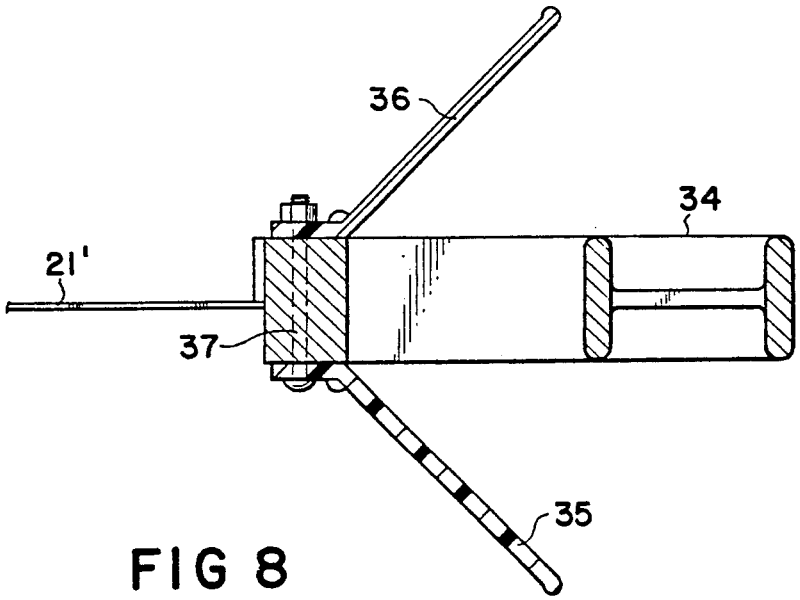
FIG. 8 is a cross-sectional view taken at 8—8 of FIG. 7.
Figure 9:
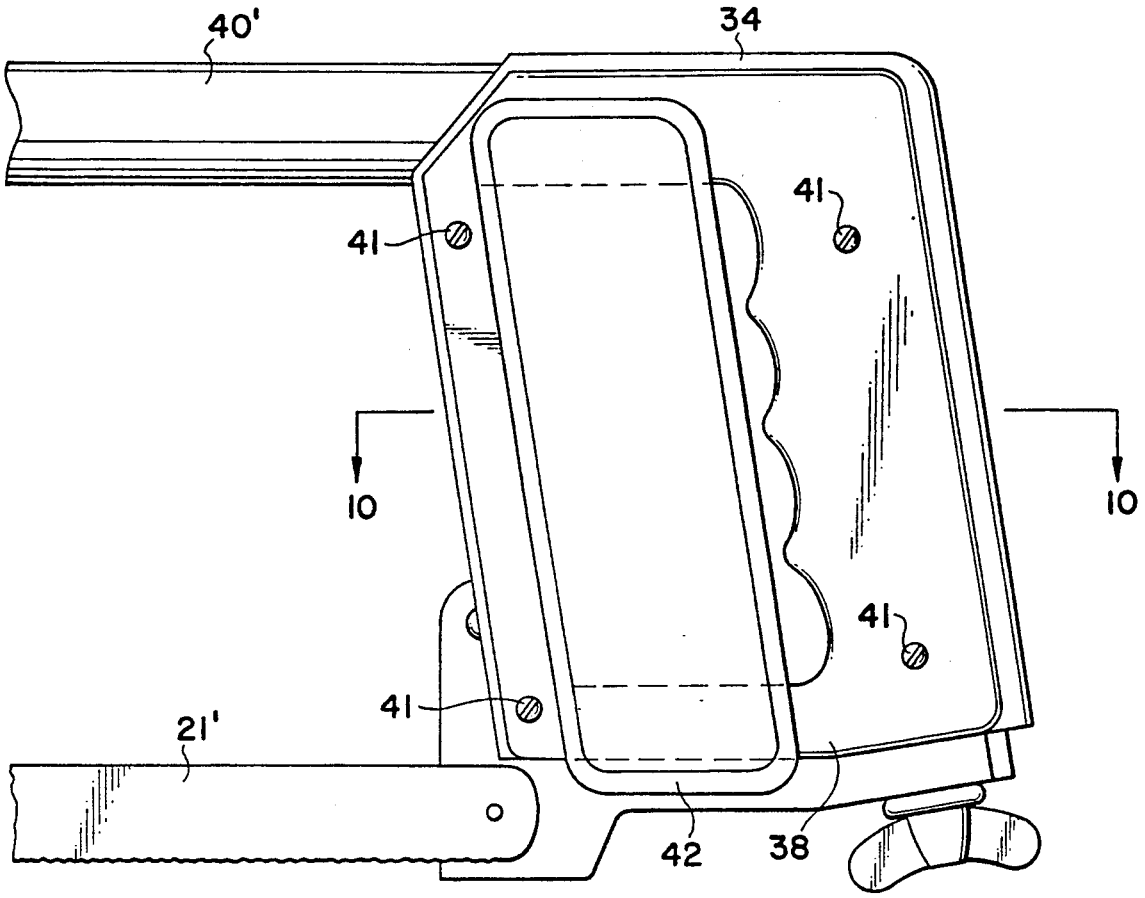
FIG. 9 is a side elevational view of a third embodiment of this invention.
Figure 10:
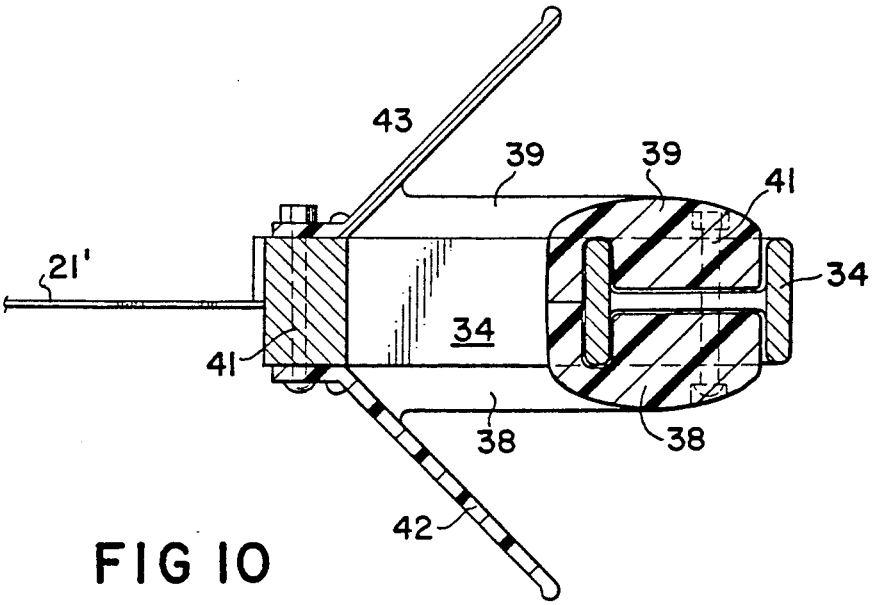
FIG. 10 is a cross-sectional view taken at 10—10 of FIG. 9.

It is important to realize that other designs can be provided which will include two hand guards such as 11 and 12 of FIGS. 1–6, and such other designs are intended to be part of this invention. For example, there is shown in FIGS. 7–8 a second embodiment of this invention wherein hacksaw 40' with blade 21' and handle 34 have two wing guards 35 (left hand) and 36 (right hand) which are attached to handle 34 by spaced bolt and nut means 37. In FIGS. 9–10 molded finger grip members 38 and 39 are attached to handle 34 by spaced bolt and nut means 41. Wing guards 42 and 43 are molded integrally with finger grip members 38 and 39, respectively. Other equivalent designs may be devised by those skilled in the art based upon these various embodiments of this invention.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A hand guard for a hacksaw having a handle, a frame and a blade, said hard guard comprising a pair of mating halves that are substantially mirror images of each other, each said half including an integral supporting flange for clamping around the hacksaw frame adjacent the handle and a wing shield member tapering outwardly and rearwardly from said flange, clamping means for releasably locking said pair of halves together around the hacksaw.

2. The hand guard of claim 1 wherein each said flange includes a semicircular groove and at least one pair of spaced grooves spaced outwardly of each side of said semicircular groove, and adapted, respectively to fit, optionally, a frame with a semicircular cross-section and a frame with a rectangular cross-section.

3. The hand guard of claim 1 wherein said clamping means includes a pair of cooperating screw-threaded members.

4. The hand guard of claim 1 wherein said two mating halves have planar faces which are joined face-to-face when clamped into operating position.

5. The hand guard of claim 1 wherein each said wing shield member includes at least one brace adapted and arranged to engage the frame adjacent the handle to inhibit rotation of said wing shield member about the frame.

6. The hand guard of claim 1 wherein an included angle between said flange and said wing shield member is an obtuse angle.

7. The hand guard of claim 8 wherein said clamping means includes at least a pair of connectors attached to said flanges below and above the frame of tile hacksaw.

8. The hand guard of claim 1 wherein each said wing shield member is attached directly to the handle of the hacksaw by said clamping means.

9. The hand guard of claim 1 wherein each said mating half includes a finger grip member attached to the handle by bolt means, said finger grip member and said wing shield member of respective said mating halves being integral.

10. A hand guard for a hacksaw having a handle and a blade supported by a substantially U-shaped frame attached to the handle, and a releasable connecting member for the blade adjacent the handle, said hand guard comprising a pair of mating members which are substantially mirror images of each other, each said member including an integral supporting flange adapted for clamping about the hacksaw frame which extends parallel to the blade and adjacent its attachment to the handle, each said mating member having a wing shield tapering outwardly and rearwardly toward the handle from said flange, each of said wing shields extending from adjacent the frame attachment to the handle and terminating adjacently below the blade connecting member adjacent the handle, and clamping means for firmly attaching said pair of mating members together.

11. The hand guard of claim 10 wherein each said flange includes an arcuate groove and at least one pair of spaced grooves located outwardly of each side of said arcuate groove, said pair of spaced grooves being adapted to firmly accommodate the frame of a rectangular cross-section, and said arcuate groove accommodating the frame of a circular cross-section.

12. The hand guard of claim 10 wherein each said wing shield includes at least one brace adapted and arranged to engage the frame adjacent the handle to inhibit rotation of said wings shields about the frame.

13. The hand guard of claim 10 wherein said clamping means includes threaded members.

14. The hand guard of claim 10 wherein said flanges include generally planar faces which are positioned face-to-face and are generally engaged when connected by said clamping means.

15. The hand guard of claim 10 wherein an included angle between said flange and said wing shield is an obtuse angle.

16. The hand guard of claim 15 wherein said obtuse angle is between 120 degrees and 160 degrees.

17. The hand guard of claim 10 wherein said clamping means includes at least a pair of connectors attached to said flanges below and above the frame of the hacksaw.

18. The hand guard of claim 10 wherein each said wing shield includes at least one brace adapted and arranged to engage the frame adjacent the handle to inhibit rotation of said wing shields about the frame, said clamping means including at least three connectors attached to said flanges with two of said connectors respectively spaced above and below said frame and a third of said connectors spaced adjacent said at least one brace.

19. The hand guard of claim 10 wherein each said mating member includes a flange integral with said wing shield, said clamping means including a pair of spaced bolt and nut means connecting each said flange to each other.

20. The hand guard of claim 10 wherein each said mating member includes a finger grip member integral with said wing shield, said clamping means including two pair of spaced bolt and nut means with one of said two pair located adjacent said finger grip members and another of said two pair located forward of and adjacent said wing members.

* * * * *